US011145257B2

(12) United States Patent
Chang et al.

(10) Patent No.: US 11,145,257 B2
(45) Date of Patent: Oct. 12, 2021

(54) DISPLAY DEVICE DRIVING METHOD AND RELATED DRIVER CIRCUIT

(71) Applicant: NOVATEK Microelectronics Corp., Hsinchu (TW)

(72) Inventors: Chieh-Hsiang Chang, Miaoli County (TW); Shih-Hsiang Pan, Miaoli County (TW); Chi-Hung Lin, Hsinchu County (TW); Wen-Pin Tsai, Hsinchu (TW); Huang-Chin Tang, Hsinchu County (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 16/779,662

(22) Filed: Feb. 2, 2020

(65) Prior Publication Data

US 2021/0241701 A1 Aug. 5, 2021

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2310/0286* (2013.01); *G09G 2310/0297* (2013.01)

(58) Field of Classification Search
CPC ..... G09G 3/3291; G09G 3/3233; G09G 2310/0286; G09G 2310/0297
See application file for complete search history.

(56) References Cited

U.S. PATENT DOCUMENTS

2009/0002281 A1* 1/2009 Okamoto ..... G09G 3/3241 345/76
2010/0321422 A1* 12/2010 Ishiguro ..... G09G 3/3233 345/698
2011/0025678 A1* 2/2011 Chung ..... G09G 3/3233 345/213
2012/0188150 A1* 7/2012 Shirouzu ..... G09G 3/3233 345/76
2014/0092144 A1* 4/2014 Kim ..... G09G 3/3291 345/690

(Continued)

FOREIGN PATENT DOCUMENTS

EP 3483872 A1 5/2019
JP 2009-63665 A 3/2009
TW 201621863 A 6/2016

*Primary Examiner* — Ibrahim A Khan
(74) *Attorney, Agent, or Firm* — CKC & Partners Co., LLC

(57) ABSTRACT

A display device driving method, suitable for a driver circuit, includes the following steps: determining magnitude of a plurality of data voltages according to received display data, and the plurality of data voltages are configured to be transmitted to a plurality of pixel circuits via a plurality of data lines; comparing the magnitude of the plurality of data voltages to generate a comparison result; and before providing corresponding ones of the plurality of data voltages to a first pixel group arranged at an i-th row of the plurality of pixel circuits, providing a first reset voltage having a value determined according to the comparison result to the plurality of data lines, or providing a second reset voltage to m data lines selected according to the comparison result from the plurality of data lines, i is a positive integer, and m is an integer.

14 Claims, 12 Drawing Sheets

(56) References Cited

U.S. PATENT DOCUMENTS

| | | | | |
|---|---|---|---|---|
| 2015/0077314 | A1* | 3/2015 | Kim | G09G 3/3233 345/76 |
| 2015/0103065 | A1* | 4/2015 | Kim | G09G 3/3688 345/212 |
| 2015/0123961 | A1* | 5/2015 | Park | G09G 3/3688 345/212 |
| 2015/0221251 | A1* | 8/2015 | Wang | G09G 3/3208 345/690 |
| 2016/0163255 | A1 | 6/2016 | Kim et al. | |
| 2018/0166010 | A1* | 6/2018 | Park | G09G 3/3233 |
| 2019/0237010 | A1* | 8/2019 | Lin | G09G 3/3225 |
| 2020/0013345 | A1* | 1/2020 | Jeong | H01L 27/3276 |
| 2020/0135110 | A1* | 4/2020 | Yokoyama | G09G 3/3233 |

* cited by examiner

DISPLAY DEVICE DRIVING METHOD AND RELATED DRIVER CIRCUIT

BACKGROUND

Field of Invention

The present disclosure generally relates to a display device driving method. More particularly, the present disclosure relates to a driving method for resetting voltages of data lines of the display device.

Description of Related Art

The display panel usually comprises a plurality of multiplexers coupled between the display driver integrated circuit (DDIC) and the data lines, wherein the multiplexer allows a channel (output pin) of the DDIC to supply data voltages to a plurality of data lines by switching different conductive paths. Therefore, when a row of pixel circuits in the display panel is coupled with the corresponding data lines, most of the corresponding data lines have not been set to the correct data voltages. The residual charges on the data lines that have not had the correct data voltages may transfer into the pixel circuits. Organic light-emitting diode (OLED) pixel circuits usually forms a diode-connected structure for receiving a data voltage and/or for detecting a threshold voltage of a driving transistor thereof. The residual charges on the data lines may cause the diode-connected structure to be switched-off while receiving the data voltage from the DDIC.

SUMMARY

The disclosure provides a display device driving method suitable for a driver circuit. The display device driving method includes the following steps: determining magnitude of a plurality of data voltages according to received display data, and the plurality of data voltages are configured to be transmitted to a plurality of pixel circuits via a plurality of data lines; comparing the magnitude of the plurality of data voltages to generate a comparison result; and before providing corresponding ones of the plurality of data voltages to a first pixel group arranged at an i-th row of the plurality of pixel circuits, providing a first reset voltage having a value determined according to the comparison result to the plurality of data lines, or providing a second reset voltage to m data lines selected according to the comparison result from the plurality of data lines, i is a positive integer, and m is an integer.

The disclosure provides a driver circuit configured to be coupled with a plurality of pixel circuits through a plurality of data lines. The driver circuit is adapted to: determine magnitude of a plurality of data voltages according to received display data, and the plurality of data voltages are configured to be transmitted to the plurality of pixel circuits via the plurality of data lines; compare the magnitude of the plurality of data voltages to generate a comparison result; and before provide corresponding ones of the plurality of data voltages to a first pixel group arranged at an i-th row of the plurality of pixel circuits, providing a reset voltage having a value determined according to the comparison result to the plurality of data lines, or resetting voltages of m data lines selected according to the comparison result from the plurality of data lines, i is a positive integer, and m is an integer.

It is to be understood that both the foregoing general description and the following detailed description are by examples, and are intended to provide further explanation of the disclosure as claimed.

DETAILED DESCRIPTION

Figure 1:
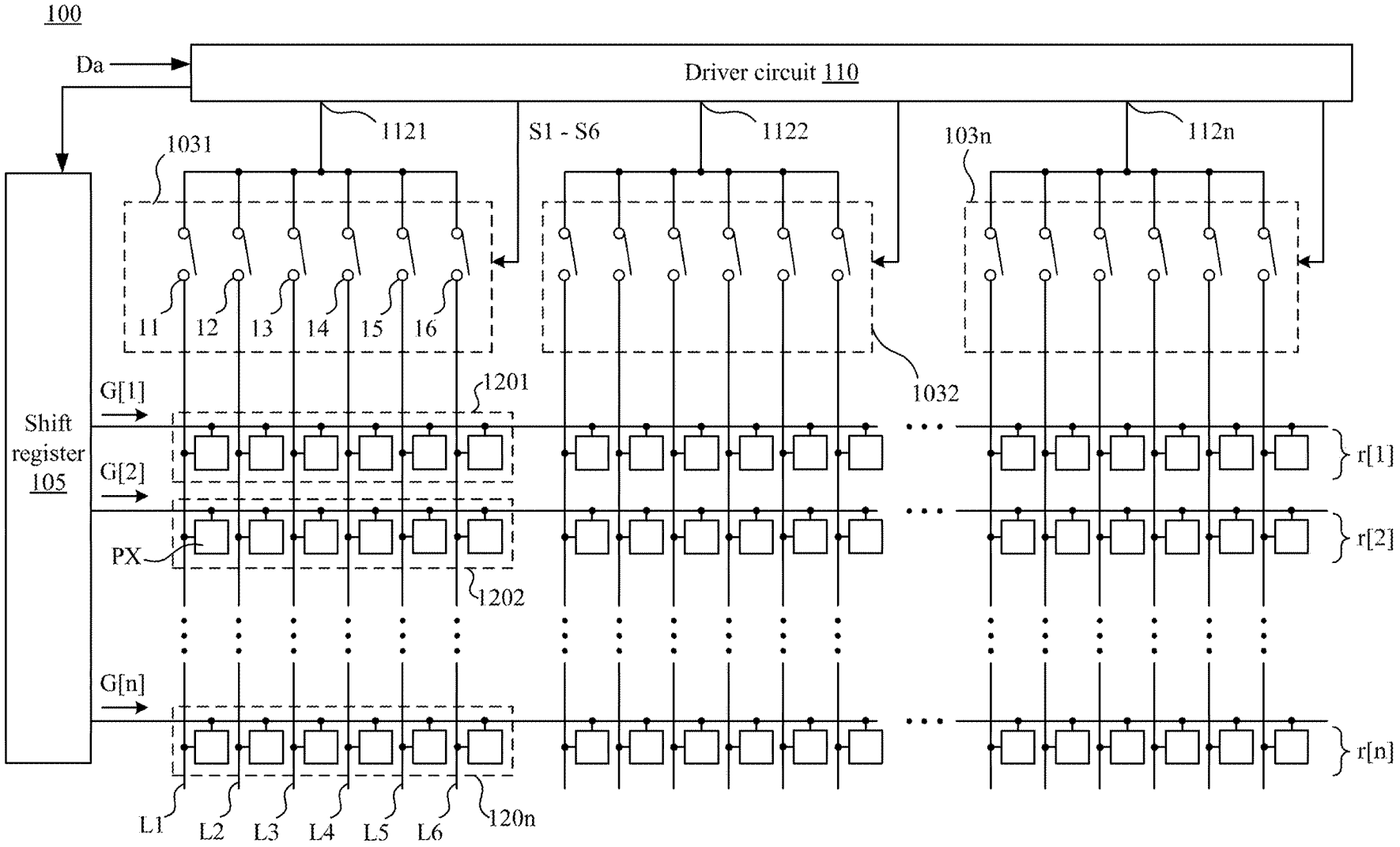
FIG. 1 is a simplified functional block diagram of a display device according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a display device 100 according to one embodiment of the present disclosure. The display device 100 comprises a driver circuit 110, a plurality of multiplexers 1031-103*n*, a shift register 105, a plurality of pixel circuits PX, a plurality of data lines, and a plurality of gate lines. The driver circuit 110 comprises a plurality of channels (output pins) 1121-112*n*. The driver circuit 110 is coupled with the data lines through the multiplexers 1031-103*n* to reduce the required number of channels 1121-112*n*. The shift register 105 is coupled with the gate lines, and the pixel circuits PX are arranged at positions corresponding to intersections of the gate lines and the data lines. Therefore, the pixels circuits PX form a plurality of pixel rows r[1]-r[n].

The multiplexers 1031-103*n*, the shift register 105, and the pixel circuits PX may be disposed on a substrate (not shown in FIG. 1), where the driver circuit 110 may be disposed on a flexible printed circuit board (not shown in FIG. 1) with the chip-on-film (COF) technology. In practice, the substrate may be a glass substrate, a plastic substrate, or a polyamide substrate. The driver circuit 110 may be realized by a display driver integrated circuit (DDIC), a general purpose single- or multi-chip processors, digital signal processors (DSPs), application specific integrated circuits (ASICs), field programmable gate arrays (FPGAs), or other programmable logic devices. In some embodiments, the driver circuit 110 may be disposed on the substrate together with the multiplexers 1031-103*n*, the shift register 105, and the pixel circuits PX with the chip-on-glass (COG) technology, the chip on polymer technology, or the chip on plastic technology.

Each of the multiplexers 1031-103*n* comprises a plurality of switches, and each of the switches is coupled between a corresponding data line and the driver circuit 110. The driver circuit 110 is configured to correspondingly provide control signals to the switches so that each of the switches is individually controlled. For example, the driver circuit 110 provides the control signals S1-S6 to the switches 11-16 of the multiplexer 1031, respectively. For the purpose of explanatory convenience, each of the multiplexers 1031-103*n* in FIG. 1 comprises six switches, but this disclosure is not limited thereto. The number of switches of each of the multiplexers 1031-103*n* may be determined based on practical requirements such as resolution of the display device 100. For example, the number of switches of each multiplexer may be set to be 4, 5, 10, 12, or other suitable values.

The driver circuit 110 is further configured to receive display data Da and store the display data Da in a plurality of memory areas (not shown in FIG. 1). The display data Da specifies a gray scale value (brightness) for each of the pixel circuits PX. The shift register 105 is configured to provide gate signals G[1]-G[n] via the gate lines for selecting the corresponding pixel rows r[1]-r[n]. When one of the pixel rows r[1]-r[n] is selected by the shift register 105, the driver circuit 110 provides data voltages converted from the display data Da for each of pixel circuits PX of the pixel row being selected.

Figure 2A:
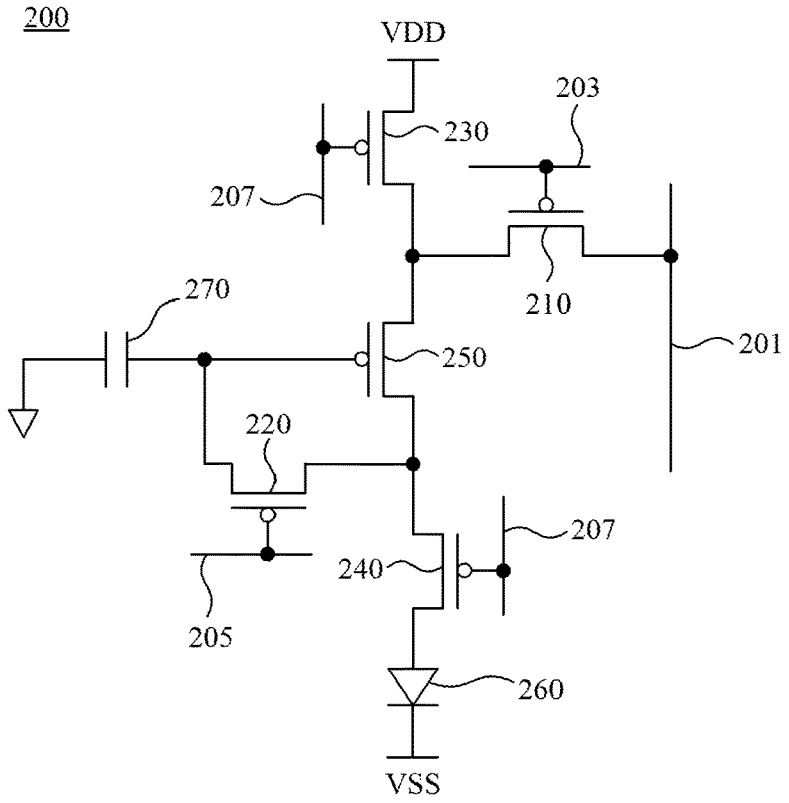
FIG. 2A is a schematic diagram of a pixel circuit according to one embodiment of the present disclosure.
Figure 2B:
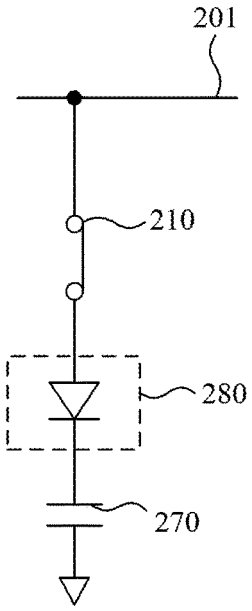
FIG. 2B is a schematic diagram of an equivalent circuit of the pixel circuit of FIG. 2A being selected by the shift register.

FIG. 2A is a schematic diagram of a pixel circuit 200 according to one embodiment of the present disclosure. FIG. 2B is a schematic diagram of an equivalent circuit of the pixel circuit 200 being selected by the shift register 105. In some embodiments, the pixel circuits PX of the display device 100 may be realized by the pixel circuit 200. The pixel circuit 200 comprises switching transistors 210-240, a driving transistor 250, a lighting element 260, and a capacitor 270. A first terminal of the switching transistor 210 is configured to receive data voltage from a data line 201, and the data line 201 may be one of the data lines of FIG. 1 coupled with the driver circuit 110. A second terminal of the switching transistor 210 is coupled with the driving transistor 250. A control terminal of the switching transistor 210 is coupled with a gate line 203, and the gate line 203 may be one of the gate lines of FIG. 1 for transmitting a corresponding one of the gate signals G[1]-G[n]. The control terminals of the switching transistors 220-240 are coupled with gate lines 205 and 207, and the gate lines 205 and 207 may be coupled with one or more shift registers the same or different from the shift register 105 of FIG. 1.

When the pixel circuit 200 is selected to receive the data voltage, the switching transistor 210, the switching transistor 220, and the driving transistor 250 are conducted, where the switching transistor 230 and the switching transistor 240 are switched off. Therefore, the driving transistor 250 and the switching transistor 220 form a diode-connected structure 280 as shown in FIG. 2B, and the data voltage may be transmitted through the diode-connected structure 280 to the capacitor 270. In addition, the diode-connected structure 280 is also configured to detect a threshold voltage of the driving transistor 250 and to store the detected threshold voltage at the capacitor 270, so as to compensate characteristic variation of the driving transistor 250.

The driving transistor 250 is configured to determine magnitude of a driving current Id according to the received data voltage, a first reference voltage VDD, and a second reference voltage VSS. The driving current Id is provided to the lighting element 260 to make the lighting element 260 generate corresponding brightness.

In practice, the switching transistors 210-240 and the driving transistor 250 may be realized by P-type thin-film transistors (TFTs). The lighting element 260 may be realized by an organic light-emitting diode (OLED) or a micro LED.

In some situations, when the switching transistor 210 is conducted and the data voltage is not yet provided to the data line 201, residual charges on the data line 201 may leak from the data line 201 to the capacitor 270. When the data voltage being provided via the data line 201, the voltage of cathode of the diode-connected structure 280 may be already becoming higher than the data voltage. As a result, the diode-connected structure 280 enters a switched-off status, and neither the data voltage nor the threshold voltage of the driving transistor 250 can be transmitted to the capacitor 270. The present disclosure provides a display device driving method 300 which can render the driver circuit 110 to reset voltages of the data lines before corresponding pixel circuits PX are selected by the shift register 105.

Figure 3:
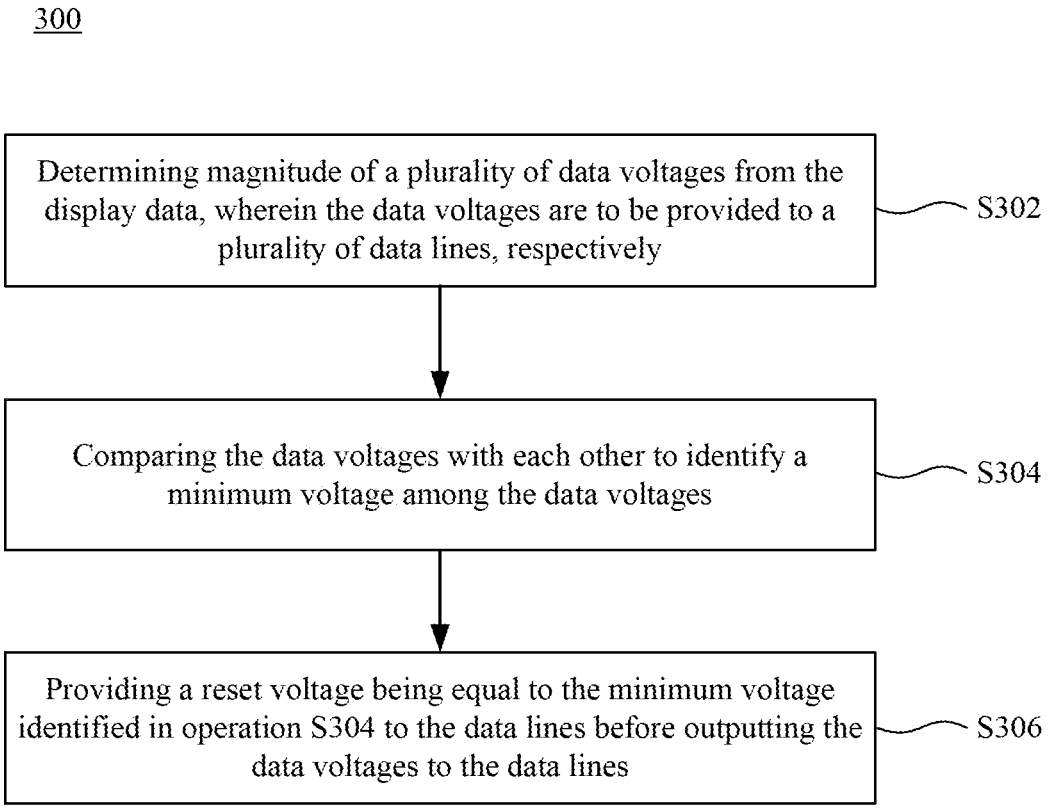
FIG. 3 is a flow chart of a display device driving method according to one embodiment of the present disclosure.
Figure 4:
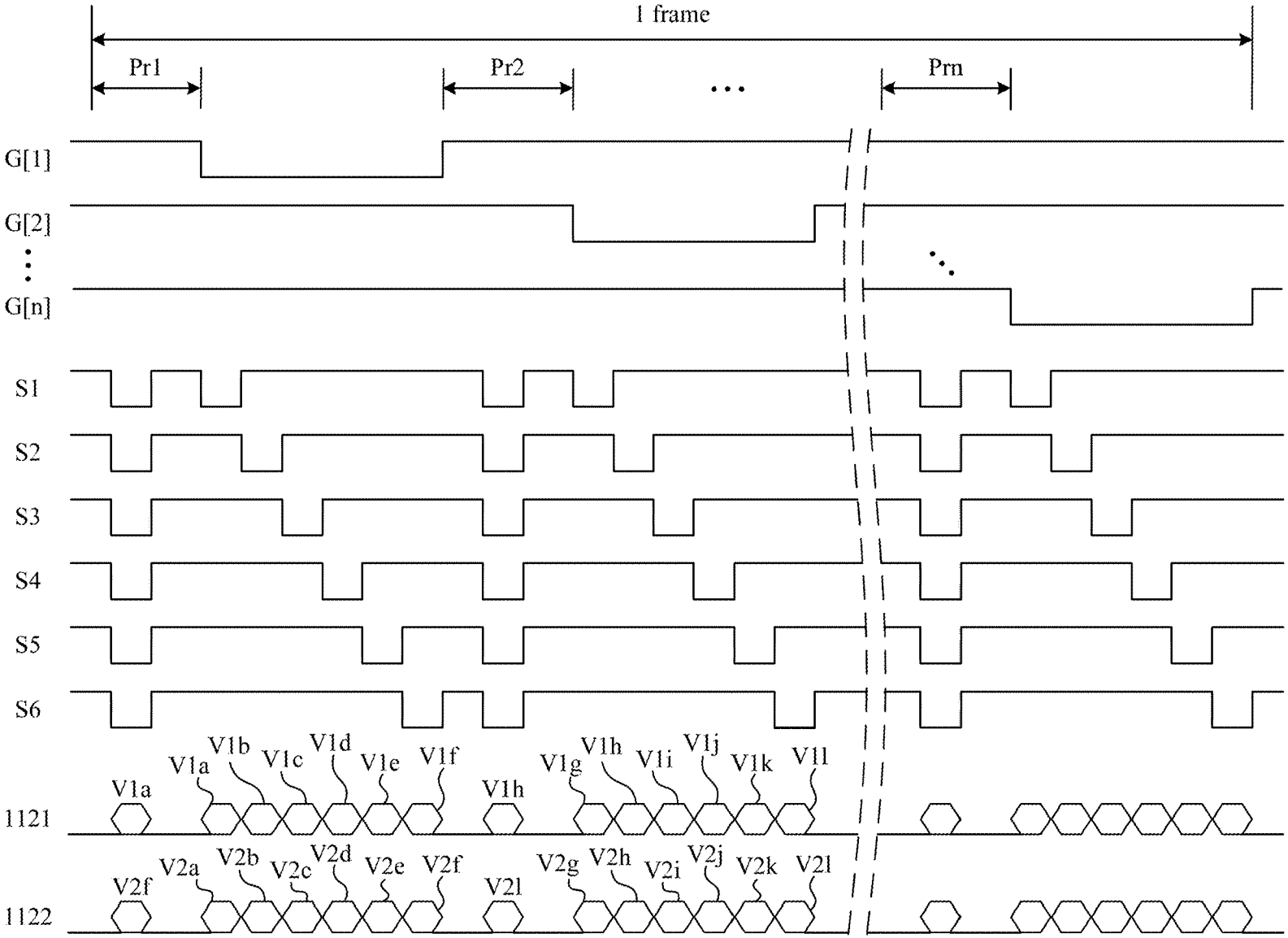
FIG. 4 is a simplified waveform schematic diagram of the display device according to one embodiment of the present disclosure.

FIG. 3 is a flow chart of the display device driving method 300 suitable for the display device 100 according to one embodiment of the present disclosure. FIG. 4 is a simplified waveform schematic diagram of the display device 100 according to one embodiment of the present disclosure. In this embodiment, the pixel circuit PX of the display device 100 may be realized by P-type transistors, for example, the pixel circuit PX may be realized by the pixel circuit 200 of FIG. 2A, but this disclosure is not limited thereto.

The driver circuit 110 may execute the display device driving method 300 to determine a reset voltage outputted by a channel for resetting a plurality data lines coupled with the channel, so as to prevent the diode-connected structure 280 being switched-off because of the residual charge leakage. The reset voltage of the channel depends on the data voltages that are to be outputted by the channel thereafter. For the purpose of explanatory convenience, the display device driving method 300 is exemplarily described in reference with the channel 1121, the multiplexer 1031, the data lines L1-L6 coupled with the multiplexer 1031, the pixel circuits PX coupled with the data lines L1-L6, wherein the pixel circuits PX coupled with the data lines L1-L6 comprise pixel groups 1201-120*n* arranged at pixel rows r[1]-r[n], respectively.

Reference is made to FIGS. 1 through 4, the driver circuit 110 may execute the display device driving method 300 in a time period Pr1 in which before the pixel group 1201 is selected by the shift register 105 via the gate signal G[1]. In operation S302, the driver circuit 110 determines magnitude of a plurality of data voltages V1*a*-V1*f* according to the display data DA. The data voltages V1*a*-V1*f* are configured to be transmitted to the pixel group 1201 via the plurality of data lines L1-L6, respectively. For example, the data voltage V1*a* is to be transmitted via the data line L1; the data voltage V1*b* is to be transmitted via the data line L2, and so on.

In operation S304, the driver circuit 110 compares the data voltages V1*a*-V1*f* with each other to identify a minimum voltage among the data voltages V1*a*-V1*f*.

In operation S306, the driver circuit 110 resets voltages of the data lines L1-L6 according to the comparison result obtained in operation S304 before outputting the data voltages V1*a*-V1*f* for the pixel group 1201. The driver circuit 110 switches the control signals S1-S6 to a logic high level, e.g., a low voltage that rendering P-type transistors to be conducted, so as to conduct all of the switches 11-16 of the multiplexer 1031. Then, the driver circuit 110 provides the reset voltage being equal to the minimum voltage identified in operation S304 to the data lines L1-L6.

For example, in this embodiment, the data voltage V1*a* is the lowest one among the data voltages V1*a*-V1*f*, and thus the driver circuit 110 sets the reset voltage to be equal to the data voltage V1*a* in operation S306.

Notably, since the driver circuit 110 resets the data lines L1-L6 before the pixel group 1201 is selected by the shift register 105 via the gate signal G[1], the gate signal G[1] provided to the pixel row r[1] remains at the logic low level during operations S302 through S306.

When the gate signal G[1] being switched to the logic high level, even if the residual charges leak into the pixel circuits PX of the pixel group 1201, the cathode of the diode-connected structure 280 of each of the pixel circuits PX in the pixel group 1201 has a voltage being lower than or equal to the data voltages V1*a*-V1*f*. As a result, the diode-connected structure 280 of each of the pixel circuits PX in the pixel group 1201 remains conducted when the driver circuit 110 outputs the data voltages V1A-V1F for the pixel group 1201.

The driver circuit 110 may execute the display device driving method 300 again in a time period Pr2 in which before the pixel group 1202 is selected by the shift register 105 via the gate signal G[2], so as to reset the data lines L1-L6 for the pixel group 1202. In this case, the driver circuit 110 determines magnitude of data voltages V1*g*-V1*l* according to the display data DA in operation S302, wherein the data voltages V1*g*-V1*l* are configured to be provided to the pixel group 1202 via the data lines L1-L6, respectively.

In operation S304, the driver circuit 110 identifies the minimum voltage among the data voltages V1*g*-V1*l*, e.g., the data voltage V1*h*. In operation S306, the driver circuit 110 sets the reset voltage to be equal to the minimum voltage, and outputs the reset voltage via the conducted switches 11-16 to the data lines L1-L6 before outputting the data voltages V1*g*-V1*l* for the pixel group 1202, and also before the gate signal G[2] being switched to the logic high level.

The driver circuit 110 may execute the display device driving method 300 in each of the time periods Pr1-Prn of one frame, by following the similar execution order as set forth above. For the sake of brevity, those descriptions will not be described here.

The driver circuit 110 may not only execute the display device driving method 300 for one channel, but may also conduct the display device driving method 300 independently and in parallel for the plurality of channels 1221-122*n* to decide the reset voltage that each of the channels 1221-122*n* should output. In other words, the two reset voltages outputted by two of the channels 1221-122*n* in parallel may be different, even though the two reset voltages are for the pixel circuits PX in the same pixel row.

Reference is made to FIGS. 1 and 4, for example, while the driver circuit 110 executes the display device driving method 300 for the channel 1121, the driver circuit 110 may also execute the display device driving method 300 independently and/or in parallel for the channel 1122. When the channel 1121 outputs the reset voltage being equal to the data voltage V1*a* in the time period Pr1, the channel 1122 outputs a reset voltage being equal to the lowest one among the data voltages V2*a*-V2*f*, e.g., the data voltage V2*f*, wherein the data voltages V2*a*-V2*f* are configured to be provided to the pixel circuits PX arranged at the pixel row r[1] and coupled with the channel 1122. Similarly, when the channel 1121 outputs the reset voltage being equal to the data voltage V1*h* in the time period Pr2, the channel 1122 may output a reset voltage being equal to the lowest one among the data voltages V2*g*-V2*l*, e.g., the data voltage V2*l*, wherein the data voltages V2*g*-V2*l* are configured to be provided to the pixel circuits PX arranged at the pixel row r[2] and coupled with the channel 1122.

Figure 5A:
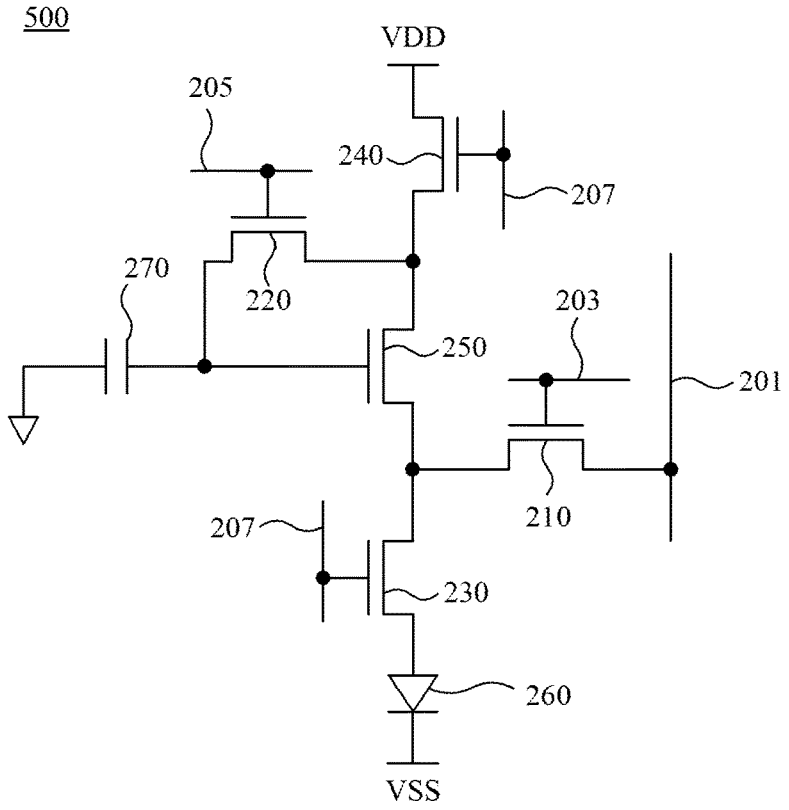
FIG. 5A is a schematic diagram of a pixel circuit according to another embodiment of the present disclosure.
Figure 5B:
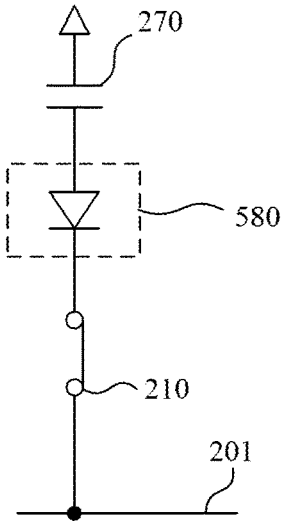
FIG. 5B is a schematic diagram of an equivalent circuit of the pixel circuit of FIG. 5A being selected by the shift register.

FIG. 5A is a schematic diagram of a pixel circuit 500 according to one embodiment of the present disclosure. FIG. 5B is a schematic diagram of an equivalent circuit of the pixel circuit 500 being selected by the shift register 105. In some embodiments, the pixel circuits PX of the display device 100 may be realized by the pixel circuit 500. The pixel circuit 500 is similar to the pixel circuit 200, and the difference is that each of the transistors of the pixel circuit 500 is an N-type transistor. As shown in FIG. 5B, a data voltage may be transmitted to the capacitor 270 via a diode-connected structure 580, wherein the capacitor 270 is coupled with an anode of the diode-connected structure 580 in this embodiment. If the anode of the diode-connected structure 580 is pulled to a voltage lower than a data voltage to be transmitted through the switching transistor 210 thereafter, the diode-connected structure 580 would be in the switched-off status when a cathode of the diode-connected structure 580 receives the data voltage from the switching transistor 210. As a result, neither the data voltage nor the threshold voltage of the driving transistor 250 can be transmitted to the capacitor 270.

Figure 6:
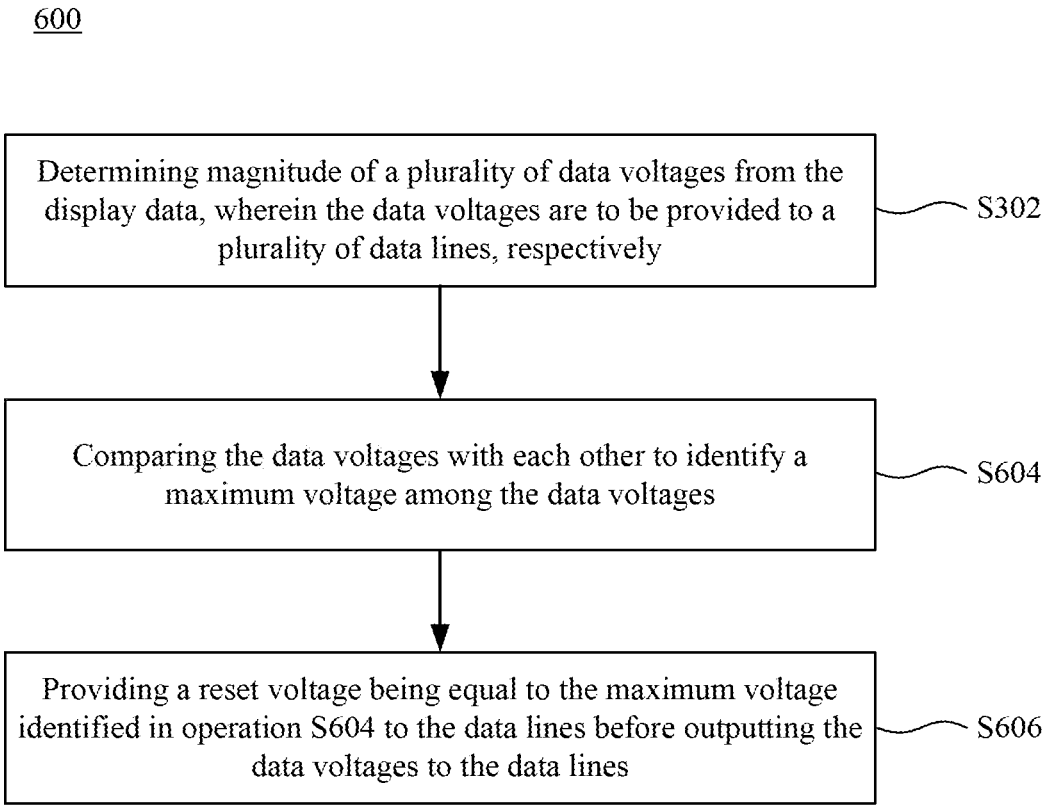
FIG. 6 is a flow chart of a display device driving method suitable for the display device according to one embodiment of the present disclosure.
Figure 7:
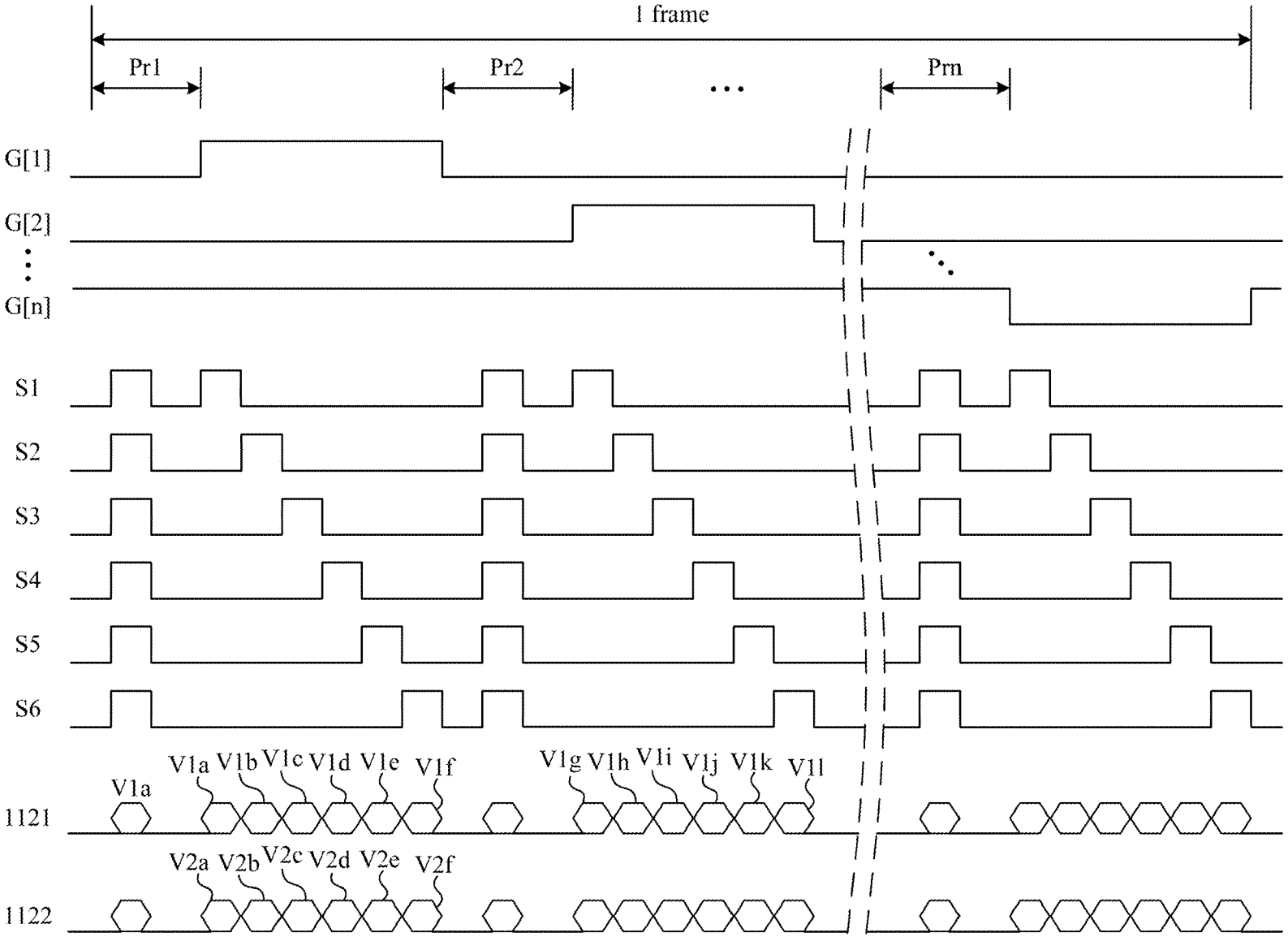
FIG. 7 is a simplified waveform schematic diagram of the display device according to one embodiment of the present disclosure.

FIG. 6 is a flow chart of a display device driving method 600 suitable for the display device 100 according to one embodiment of the present disclosure. FIG. 7 is a simplified waveform schematic diagram of the display device 100 according to one embodiment of the present disclosure. The driver circuit 110 may execute the display device driving method 600 independently and in parallel for the plurality of channels 1221-122*n* to decide the reset voltage that each of the channels 1221-122*n* should output. In this embodiment, the pixel circuit PX of the display device 100 may be realized by N-type transistors, for example, the pixel circuit PX may be realized by the pixel circuit 500 of FIG. 5A, but this disclosure is not limited thereto.

Reference is made to FIGS. 1, 6, and 7, the display device driving method 600 comprises the aforementioned operation S302, operation S604, and operation S606. In operation S604, the driver circuit 110 compares the data voltages to be outputted by a corresponding channel thereafter, e.g., the data voltages V1*a*-V1*f* to be outputted by the channel 1221, so to identify the maximum voltage among the data voltages, e.g., the data voltage V1*c*. In operation S606, the driver circuit 110 provides the reset voltage being equal to the maximum voltage identified in operation S604 to the data lines coupled with the corresponding channel, e.g., the data lines L1-L6. The foregoing descriptions regarding the other corresponding operations of the display device driving method 300 are also applicable to the display device driving method 600. For the sake of brevity, those descriptions will not be repeated here.

Accordingly, the display device 100 using the display device driving method 300 or 600 can adaptively reset the voltages of the data lines according to the data voltages to be outputted, and thus the display device 100 would not erroneously act because of the residual charges on the data lines.

In addition, when resetting the data lines, the display device 100 using the display device driving method 300 or 600 needs not to utilize the highest voltage and the lowest voltage provided to the pixel circuits PX, e.g., the first reference voltage VDD and the second reference voltage VSS of FIG. 2. Therefore, the display device driving methods 300 and 600 have an advantage of power saving.

In some embodiments, when executing the display device driving method 300, the driver circuit 110 may set the reset voltage to be equal to the maximum voltage identified in operation S304 plus or minus a fixed value. As a result, the charging speed at which the driver circuit 110 charges the data lines is increased. The fixed value may be stored in the memory areas of the driver circuit 110.

Similarly, in some embodiments, when executing the display device driving method 600, the driver circuit 110 may set the reset voltage to be equal to the minimum voltage identified in operation S604 plus or minus a fixed value, however, this disclosure is not limited thereto. When the maximum (or minimum) voltage reaches the upper-limit voltage (or the lower-limit voltage) that the driver circuit can provide, the driver circuit 110 may set the reset voltage to be equal to the upper-limit voltage (or the lower-limit voltage) without plus or minus the fixed value.

Figure 8A:
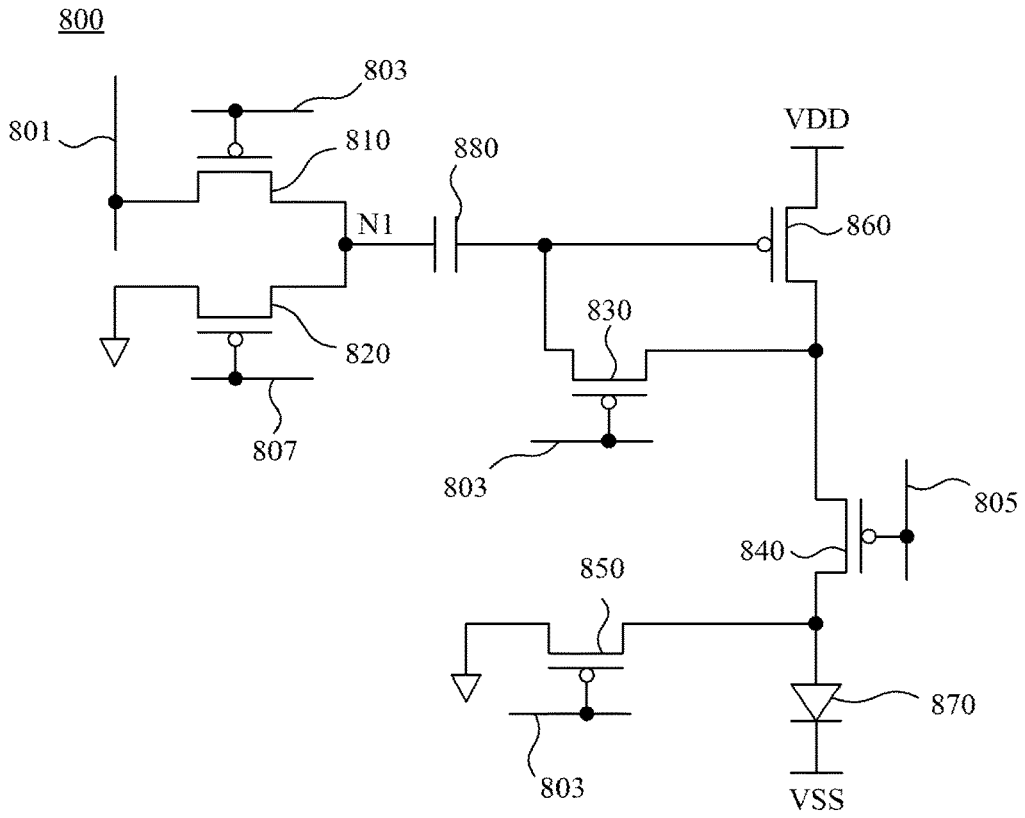
FIG. 8A is a schematic diagram of a pixel circuit according to another embodiment of the present disclosure.
Figure 8B:
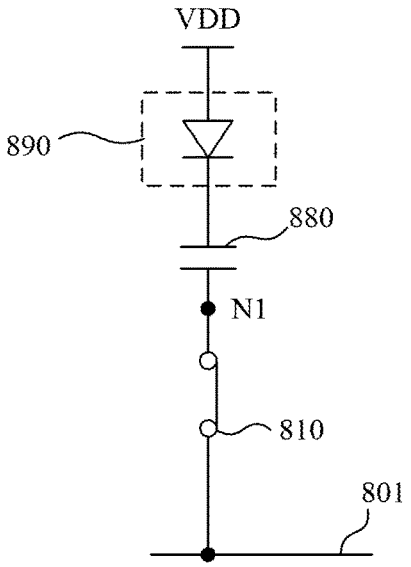
FIG. 8B is a schematic diagram of an equivalent circuit of the pixel circuit of FIG. 8A being selected by the shift register.

FIG. 8A is a schematic diagram of a pixel circuit 800 according to one embodiment of the present disclosure. FIG. 8B is a schematic diagram of an equivalent circuit of the pixel circuit of FIG. 8A being selected by the shift register 105. In some embodiments, the display device driving method 600 is also suitable for the display device 100 with P-type pixel circuits PX, such as the pixel circuit 800 of FIG. 8A. The pixel circuit 800 comprises switching transistors 810-850, a driving transistor 860, a lighting element 870, and a capacitor 880. A first terminal of the switching transistor 810 is configured to receive data voltage from a data line 801, and the data line 801 may be one of the data lines of FIG. 1 coupled with the driver circuit 110. A second terminal of the switching transistor 810 is coupled with the capacitor 880. A control terminal of the switching transistor 810 is coupled with a gate line 803, and the gate line 803 may be one of the gate lines of FIG. 1 for transmitting a corresponding one of the gate signals G[1]-G[n]. The control terminals of the switching transistors 820-850 are coupled with gate lines 805 and 807, and the gate lines 805 and 807 may be coupled with one or more shift registers the same or different from the shift register 105 of FIG. 1.

When the pixel circuit 800 is selected to receive the data voltage, the switching transistor 810, the switching transistor 830, the switching transistor 850, and the driving transistor 860 are conducted, where the switching transistor 820 and switching transistor 840 are switched off. Therefore, the driving transistor 860 and the switching transistor 830 form a diode-connected structure 890 as shown in FIG. 8B. The diode-connected structure 890 is configured to detect a threshold voltage of the driving transistor 860 and to store the detected threshold voltage at the capacitor 880, so as to compensate characteristic variation of the driving transistor 860.

When the switching transistor 810 is conducted and the data voltage is not yet provided to the data line 801, residual charges on the data line 801 may leak from the data line 801 to the capacitor 880 (i.e., to the first node N1). The voltage of the first node N1 may be set to be lower than the data voltage to be provided to the data line 801 because of the residual charges. As a result, when the data voltage is transmitted to the first node N1, the voltage of the cathode of the diode-connected structure 890 may be raised up to be higher than the first reference voltage VDD, thereby the diode-connected structure 890 may enters the switched-off status. Therefore, the threshold voltage of the driving transistor 860 cannot be transmitted to the capacitor 880.

To overcome the abovementioned problem, the display device driving method 600 may be applied to the display device 100 with the P-type pixel circuits PX. In this situation, for example, the data line 801 of FIG. 8A is reset to the maximum voltage among the data voltages to be outputted by a channel in operation S606, and thus the diode-connected structure 890 would not be switched off when the pixel circuit 800 is selected.

Figure 9:
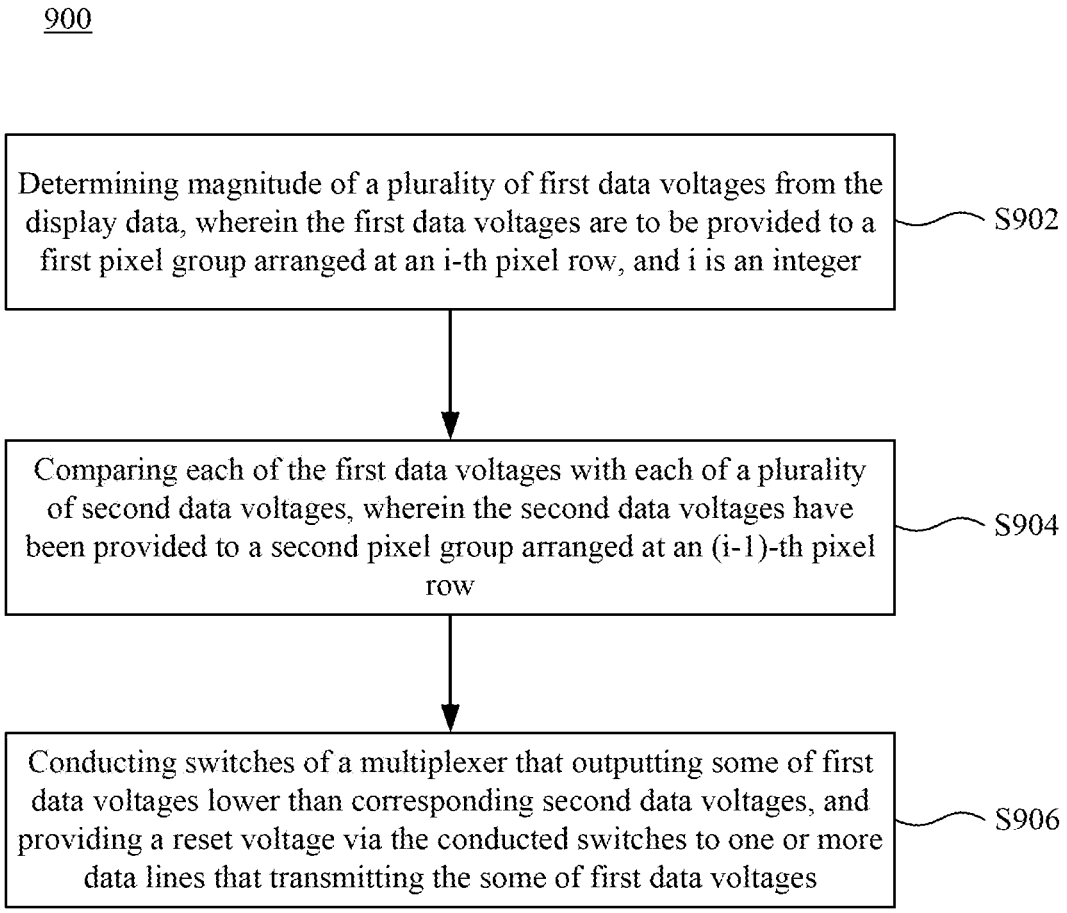
FIG. 9 is a flow chart of a display device driving method suitable for the display device according to another embodiment of the present disclosure.
Figure 10:
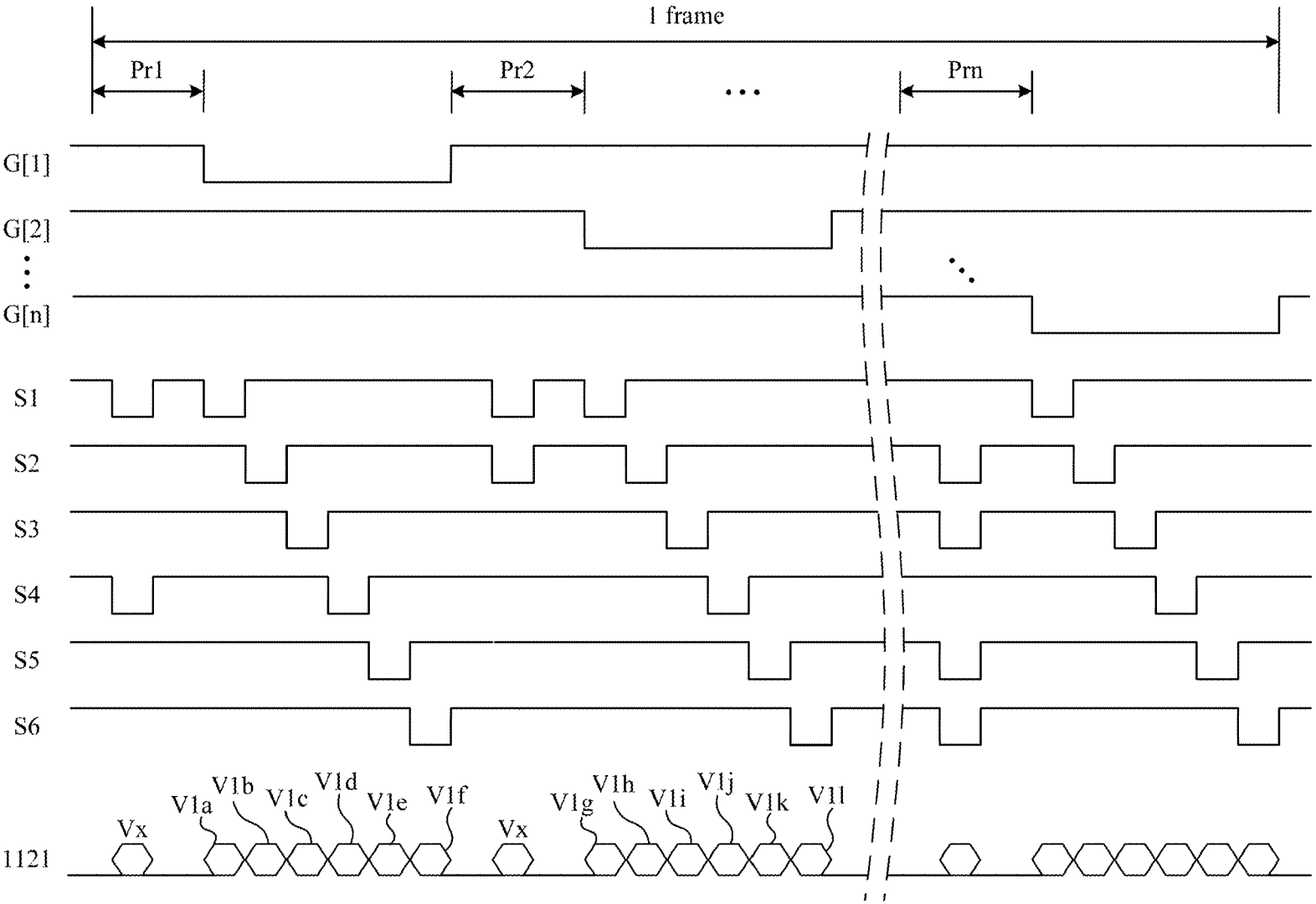
FIG. 10 is a simplified waveform schematic diagram of the display device according to another embodiment of the present disclosure.

FIG. 9 is a flow chart of a display device driving method 900 suitable for the display device 100 according to one embodiment of the present disclosure. FIG. 10 is a simplified waveform schematic diagram of the display device 100 according to one embodiment of the present disclosure. Reference is made to FIGS. 1, 9, and 10, the driver circuit 110 may execute the display device driving method 900 to determine whether to provide a reset voltage via a corresponding channel for resetting the data lines coupled with the corresponding channel, wherein the driver circuit 110 determines according to data voltages that are to be outputted by the corresponding channel and data voltages that are previously outputted by the corresponding channel. For the purpose of explanatory convenience, the display device driving method 900 is exemplarily described in reference with the channel 1121, the multiplexer 1031, the data lines L1-L6 coupled with the multiplexer 1031, and the pixel groups 1201-120*n* arranged at pixel rows r[1]-r[n], respectively. In this embodiment, the pixel circuit PX of the display device 100 may be realized by P-type transistors, for example, the pixel circuit PX may be realized by the pixel circuit 200 of FIG. 2A, but this disclosure is not limited thereto.

The display device 100 may execute the display device driving method 900 in the time period Pr2. In operation S902, the driver circuit 110 determines magnitude of the plurality of data voltages V1*g*-V1*l* according to the display data DA.

In operation S904, the driver circuit 110 correspondingly compares the magnitude of the data voltages V1*g*-V1*l* with the magnitude of the data voltages V1*a*-V1*f*. The data voltages V1*a*-V1*f* have been provided to the pixel group 1201 arranged at the pixel row r[1], and the data voltages V1*g*-V1*l* are to be provided to the pixel group 1202 arranged at the pixel row r[2]. Specifically, the driver circuit 110 identifies magnitude of the plurality of data voltages V1*g*-V1*l*, and also identifies magnitude of the plurality of data voltages V1*a*-V1*f*. The driver circuit 110 compares the magnitude of each of the data voltages V1*g*-V1*l* with the magnitude of each of the data voltages V1*a*-V1*f*, wherein one of the data voltages V1*g*-V1*l* and one of the data voltages V1*a*-V1*f* being compared with each other are transmitted via the same data line.

For example, the driver circuit 110 compares the data voltage V1*g* with the data voltage V1*a* that both are transmitted via the data line L1. Similarly, the driver circuit 110 compares the data voltages V1*h* with the data voltage V1*b* that both are transmitted via the data line L2, and so on.

In operation S906, the driver circuit 110 determines which switches of the multiplexer 1031 to be conducted according to the comparison result obtained in operation S904, so that the driver circuit 110 may selectively provide the reset voltage to one or more of the data lines L1-L6. If the data voltage to be outputted is higher than or equal to the data voltage previously outputted, the driver circuit 110 would not provide the reset voltage to a corresponding data line before outputting the data voltage to be outputted via the corresponding data line. If the data voltage to be outputted is lower than the data voltage previously outputted, the driver circuit 110 selects the corresponding data line to receive the reset voltage before outputting the data voltage to be outputted via the corresponding data line.

As shown in table 1 and FIG. 10, for example, since the data voltages V1*g* and V1*h* are lower than the data voltages V1*a* and V1*b*, respectively, the driver circuit 110 sets the control signals S1 and S2 to the logic high level to conduct the switches 11 and 12 in the time period Pr2. As another example, since the data voltage V1*i* and V1*j* are equal to the data voltages V1*c* and V1*d*, respectively, the driver circuit 110 sets the control signals S3 and S4 to the logic low level to switch off the switches 13 and 14 in the time period Pr2. As yet another example, since the data voltage V1*k* and V1*l* are higher than the data voltages V1*e* and V1*f*, respectively, the driver circuit 110 sets the control signals S5 and S6 to the logic low level to switch off the switches 15 and 16 in the time period Pr2. The driver circuit 110 provides the reset voltage to the data lines L1 and L2 before respectively providing the data voltages V1*g* and V1*l* to the data lines L1 and L2. On the other hand, the driver circuit 110 provides the data voltages V1*i*-V1*l* to the data lines L3-L6, respectively, without providing the reset voltage to the data lines L3-L6.

TABLE 1

| Data voltage V1a | Data voltage V1b | Data voltage V1c | Data voltage V1d | Data voltage V1e | Data voltage V1f |
|---|---|---|---|---|---|
| 0.3 V | 0.3 V | 0.3 V | 0.4 V | 0.4 V | 0.4 V |
| Data voltage V1g | Data voltage V1h | Data voltage V1i | Data voltage V1j | Data voltage V1k | Data voltage V1l |
| 0.2 V | 0.2 V | 0.3 V | 0.4 V | 0.5 V | 0.5 V |

In this embodiment, the reset voltage may set to a first predetermined value Vx stored in the memory areas of the driver circuit 110. The first predetermined value Vx is lower than or equal to the lowest data voltage provided to the pixel circuits PX.

In some embodiments, the first predetermined value Vx may be equal to the second reference voltage VSS of FIG. 2A.

In some embodiments, the driver circuit 110 further identifies the minimum voltage among the data voltages to be outputted, e.g., among the data voltages V1*g*-V1*l*, in operation S904. In operation S906, the driver circuit 110 sets the reset voltage to be equal to the minimum voltage identified in operation S904.

In other embodiments, if the driver circuit 110 determines in operation S902 that the data voltages V1*g*-V1*l* corresponding to the lowest gray scale value identified by the display data Da or by the driver circuit 110, the driver circuit 110 may omit operations S904 and S906. That is, the driver circuit 110 may provide the data voltages V1*g*-V1*l* to the pixel group 1202 without providing the reset voltage to the data lines L1-L6.

Figure 11:
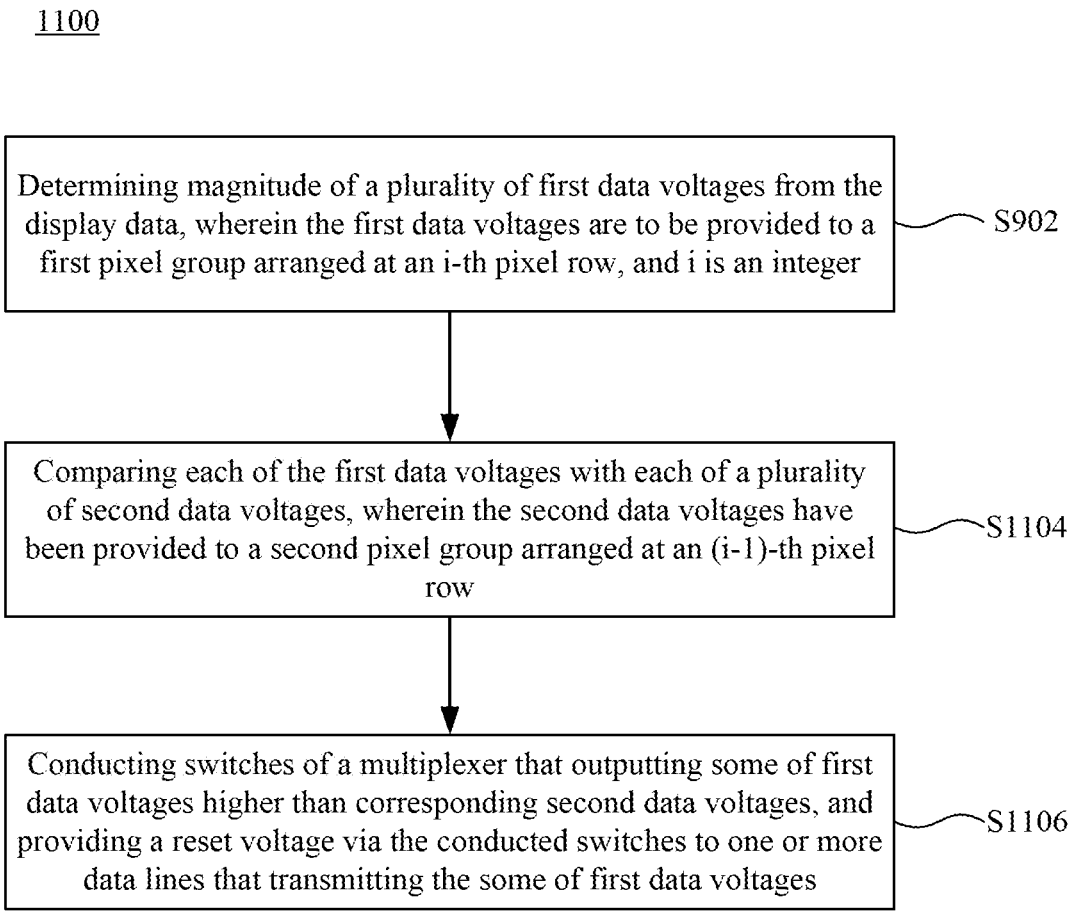
FIG. 11 is a flow chart of a display device driving method suitable for the display device according to another embodiment of the present disclosure.
Figure 12:
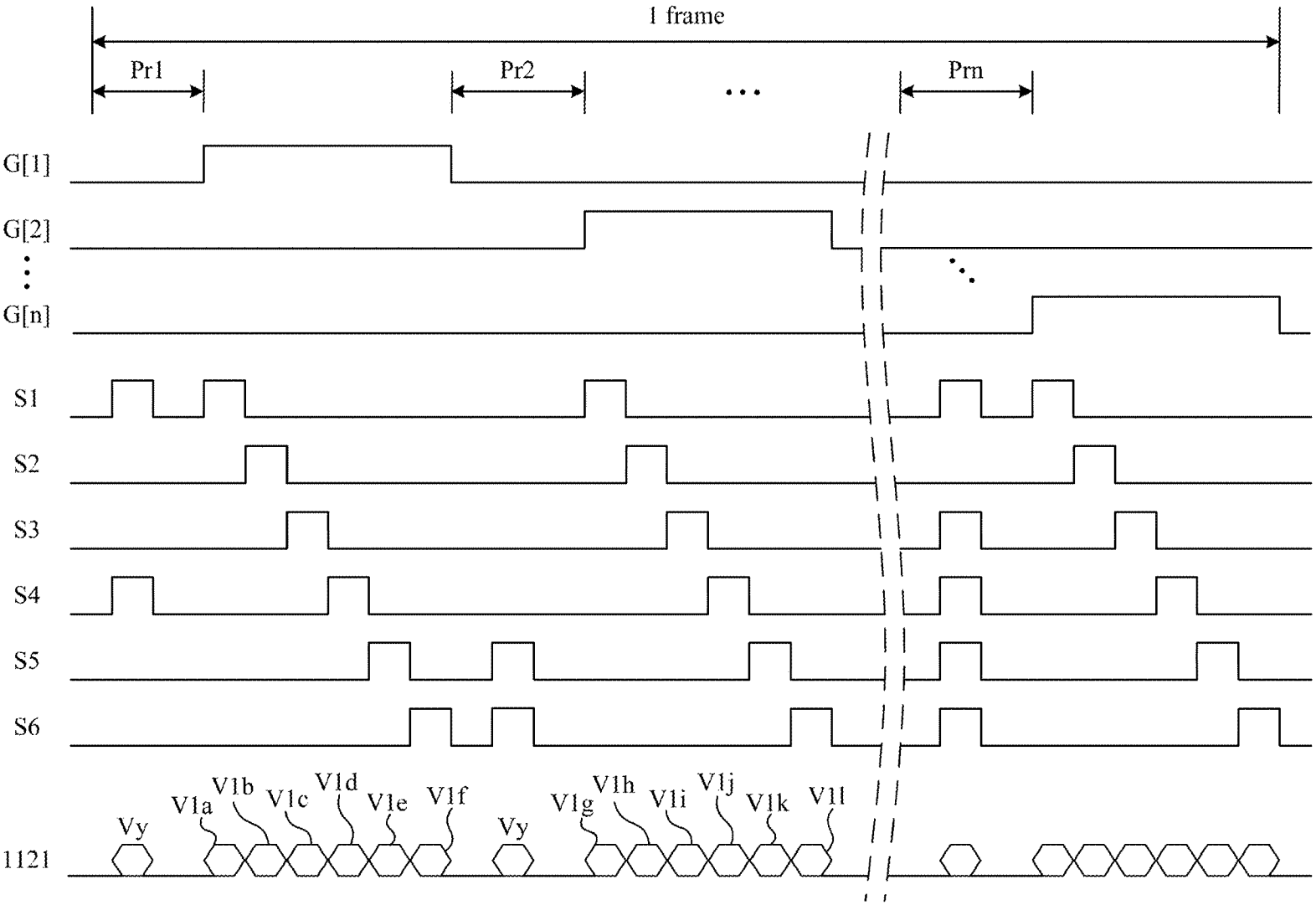
FIG. 12 is a simplified waveform schematic diagram of the display device according to another embodiment of the present disclosure.

FIG. 11 is a flow chart of a display device driving method 1100 suitable for the display device 100 according to one embodiment of the present disclosure. FIG. 12 is a simplified waveform schematic diagram of the display device 100 according to one embodiment of the present disclosure. The display device driving method 1100 comprises the aforementioned operation S902, operation S1104, and operation S1106. Reference is made to FIGS. 1, 11, and 12, the driver circuit 110 may execute the display device driving method 1100 to determine a reset voltage outputted by a corresponding channel for resetting the data lines coupled with the corresponding channel, so as to prevent the diode-connected structure 580 being switched-off because of the residual charge leakage. In this embodiment, the pixel circuit PX of the display device 100 may be realized by N-type transistors, for example, the pixel circuit PX may be realized by the pixel circuit 500 of FIG. 5A, but this disclosure is not limited thereto. In other embodiments, the display device driving method 1100 is also suitable for display device 100 with P-type pixel circuits PX, such as the pixel circuit 800 of FIG. 8A.

In operation S1104, the driver circuit 110 compares the magnitude of each of the data voltages V1*g*-V1*l* with the magnitude of each of the data voltages V1*a*-V1*f*, wherein the one of the data voltages V1*g*-V1*l* and the one of the data voltages V1*a*-V1*f* being compared with each other are transmitted via the same data line.

In operation S1106, the driver circuit 110 selectively provides the reset voltage to the data lines L1-L6 according to comparison result obtained in operation S1104, and also determines which switches of the multiplexer 1031 to be conducted according to the comparison result. If the data voltage to be outputted is lower than or equal to the data voltage previously outputted, the driver circuit 110 would not provide the reset voltage to a corresponding data line before outputting the data voltage to be outputted via the corresponding data line. If the data voltage to be outputted is higher than the data voltage previously outputted, the driver circuit 110 provides the reset voltage to a corresponding data line before outputting the data voltage to be outputted via the corresponding data line.

As shown in table 2 and FIG. 12, for example, since the data voltages V1*g* and V1*h* are lower than the data voltages V1*a* and V1*b*, respectively, the driver circuit 110 sets the control signals S1 and S2 to the logic low level to switch off the switches 11 and 12. As another example, since the data voltage V1*i* and V1*j* are equal to the data voltages V1*c* and V1*d*, respectively, the driver circuit 110 sets the control signals S3 and S4 to the logic low level to switch off the switches 13 and 14. As yet another example, since the data voltage V1*k* and V1*l* are higher than the data voltages V1*e* and V1*f*, respectively, the driver circuit 110 sets the control signals S5 and S6 to the logic high level to conduct the switches 15 and 16. The driver circuit 110 provides the reset voltage to the data lines L5 and L6 before respectively providing the data voltages V1*k* and V1*l*. On the other hand, the driver circuit 110 provides the data voltages V1*g*-V1*j* to the data lines L1-L4, respectively, without providing the reset voltage to the data lines L1-L4.

TABLE 2

| Data voltage V1a | Data voltage V1b | Data voltage V1c | Data voltage V1d | Data voltage V1e | Data voltage V1f |
|---|---|---|---|---|---|
| 0.5 V | 0.5 V | 0.5 V | 0.3 V | 0.3 V | 0.3 V |
| Data voltage V1g | Data voltage V1h | Data voltage V1i | Data voltage V1j | Data voltage V1k | Data voltage V1l |
| 0.4 V | 0.4 V | 0.5 V | 0.3 V | 0.4 V | 0.4 V |

In this embodiment, the reset voltage may be set to a second predetermined value Vy stored in the memory areas of the driver circuit 110. The second predetermined value Vy is higher than or equal to the highest data voltage provided to the pixel circuits PX.

In some embodiments, the second predetermined value Vy may be equal to the first reference voltage VDD of FIG. 2A.

In some embodiments, the driver circuit 110 further identifies the maximum voltage among the data voltages to be outputted, e.g., the data voltages V1*g*-V1*l*, in operation S1104. In operation S1106, the driver circuit 110 sets the reset voltage to be equal to the maximum voltage identified in operation S1104. The foregoing descriptions regarding the other corresponding operations of the display device driving method 900 are also applicable to the display device driving method 1100. For the sake of brevity, those descriptions will not be repeated here.

In other embodiments, if the driver circuit 110 determines in operation S902 that the data voltages V1*g*-V1*l* corresponding to the lowest gray scale value identified by the display data Da or by the driver circuit 110, the driver circuit 110 may omit operations S1104 and S1106. That is, the driver circuit 110 may provide the data voltages V1*g*-V1*l* to the pixel group 1202 without providing the reset voltage to the data lines L1-L6.

The driver circuit 110 may not only execute the display device driving method 900 or 1100 for one channel, but may also conduct the display device driving method 900 or 1100 independently and in parallel for the plurality of channels 1221-122*n*. In other words, when the driver circuit 110 reset the data lines, number of conducted switches of each of the multiplexers 1031-103*n* may be different.

Accordingly, the display device driving methods 900 and 1100 only resets corresponding data lines for the pixel circuits PX which may erroneously act because of the residual charges on the corresponding data lines, thereby having an advantage of power saving.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A display device driving method, suitable for a driver circuit, comprising:

determining magnitude of a plurality of data voltages according to received display data, wherein the plurality of data voltages are configured to be transmitted to a plurality of pixel circuits via a plurality of data lines;

comparing the magnitude of the plurality of data voltages to generate a comparison result;

before providing a plurality of first data voltages of the plurality of data voltages to a first pixel group arranged at an i-th row of the plurality of pixel circuits, providing a reset voltage to some of the plurality of data lines selected according to the comparison result while without providing the reset voltage to the others of the plurality of data lines, wherein i is a positive integer; and if the plurality of first data voltages are corresponding to a lowest gray scale value identified by the display data, providing the plurality of first data voltages to the first pixel group without comparing the magnitude of the plurality of data voltages and without providing the reset voltage to the plurality of data lines.

2. The method of claim 1, wherein the operation of comparing the magnitude of the plurality of data voltages comprises:

identifying magnitude of the plurality of first data voltages;

identifying magnitude of a plurality of second data voltages of the plurality of data voltages, wherein the plurality of second data voltages are configured to be provided to a second pixel group arranged at an (i-1)-th row of the plurality of pixel circuits; and comparing the magnitude of each of the plurality of first data voltages with the magnitude of each of the plurality of second data voltages, wherein the first data voltage and the second data voltage being compared with each other are transmitted via a same data line of the plurality of data lines.

3. The method of claim 2, wherein the operation of providing the reset voltage to the some of the plurality of data lines selected according to the comparison result while without providing the reset voltage to the other of the plurality of data lines comprises:

if some of the plurality of first data voltages are lower than corresponding ones of the plurality of second data voltages, selecting the some of the plurality of data lines that transmitting the some of the plurality of first data voltages to receive the reset voltage different from the corresponding ones of the plurality of second data voltages before providing the plurality of first data voltages to the first pixel group.

4. The method of claim 2, wherein the operation of providing the reset voltage to the some of the plurality of data lines selected according to the comparison result while without providing the reset voltage to the other of the plurality of data lines comprises:

if some of the plurality of first data voltages are higher than corresponding ones of the plurality of second data voltages, selecting the some of the plurality of data lines that transmitting the some of the plurality of first data voltages to receive the reset voltage different from the corresponding ones of the plurality of second data voltages before providing the plurality of first data voltages to the first pixel group.

5. The method of claim 2, wherein the operation of comparing the magnitude of the plurality of data voltages further comprises:

identifying a maximum voltage or a minimum voltage among the plurality of first data voltages.

6. The method of claim 5, wherein the operation of providing the reset voltage to the some of the plurality of data lines selected according to the comparison result while without providing the reset voltage to the other of the plurality of data lines comprises:

if some of the plurality of first data voltages are lower than corresponding ones of the plurality of second data voltages, selecting the some of the plurality of data lines that transmitting the some of the plurality of first data voltages to receive the reset voltage being equal to the minimum voltage before providing the plurality of first data voltages to the first pixel group.

7. The method of claim 5, wherein the operation of providing the reset voltage to the some of the plurality of data lines selected according to the comparison result while without providing the reset voltage to the other of the plurality of data lines comprises:

if some of the plurality of first data voltages are higher than corresponding ones of the second data voltages, selecting the some of the plurality of data lines that transmitting the some of the plurality of first data voltages to receive the reset voltage being equal to the maximum voltage before providing the plurality of first data voltages to the first pixel group.

8. A driver circuit configured to be coupled with a plurality of pixel circuits through a plurality of data lines, being adapted to:

determine magnitude of a plurality of data voltages according to received display data, wherein the plurality of data voltages are configured to be transmitted to the plurality of pixel circuits via the plurality of data lines;

compare the magnitude of the plurality of data voltages to generate a comparison result;

before provide a plurality of first data voltages of the plurality of data voltages to a first pixel group arranged at an i-th row of the plurality of pixel circuits, provide a reset voltage to some of the plurality of data lines selected according to the comparison result while without providing the reset voltage to the other of the plurality of data lines, wherein i is a positive integer; and if the plurality of first data voltages are corresponding to a lowest gray scale value identified by the display data, provide the plurality of first data voltages to the first pixel group without comparing the magnitude of the plurality of data voltages and without providing the reset voltage to the plurality of data lines.

9. The driver circuit of claim 8, wherein when the driver circuit compares the magnitude of the plurality of data voltages, the driver circuit is further adapted to:

identify magnitude of the plurality of first data voltages;

identify magnitude of a plurality of second data voltages of the plurality of data voltages, wherein the plurality of second data voltages are configured to be provided to a second pixel group arranged at an (i-1)-th row of the plurality of pixel circuits; and compare the magnitude of each of the plurality of first data voltages with the magnitude of each of the plurality of second data voltages, wherein the first data voltage and the second data voltage being compared with each other are transmitted via a same data line of the plurality of data lines.

10. The driver circuit of claim 9, wherein the driver circuit is configured to be coupled with the plurality of data lines through a multiplexer comprising a plurality of switches, and the driver circuit is configured to provide a plurality of control signals respectively to the plurality of switches, if some of the plurality of first data voltages are lower than corresponding ones of the plurality of second data voltages, the driver circuit sets corresponding ones of the plurality of control signals to a logic high level to select the some of the plurality of data lines to receive the reset voltage different from the corresponding ones of the plurality of second data voltages before providing the plurality of first data voltages to the first pixel group.

11. The driver circuit of claim 9, wherein the driver circuit is configured to be coupled with the plurality of data lines through a multiplexer comprising a plurality of switches, and the driver circuit is configured to provide a plurality of control signals respectively for the plurality of switches, if some of the plurality of first data voltages are higher than corresponding ones of the second data voltages, the driver circuit sets corresponding ones of the plurality of control signals to a logic high level to select the some of the plurality of data lines to receive the reset voltage different from the corresponding ones of the plurality of second data voltages before providing the plurality of first data voltages to the first pixel group.

12. The driver circuit of claim 9, wherein when the driver circuit compares the magnitude of the plurality of data voltages, the driver circuit is further adapted to identify a maximum voltage or a minimum voltage among the plurality of first data voltages.

13. The driver circuit of claim 12, wherein the driver circuit is configured to be coupled with the plurality of data lines through a multiplexer comprising a plurality of switches, and the driver circuit is configured to provide a plurality of control signals correspondingly to the plurality of switches, if some of the plurality of first data voltages are lower than corresponding ones of the second data voltages, the driver circuit sets corresponding ones of the plurality of control signals to a logic high level to select the some of the plurality of data lines to receive the reset voltage being equal to the minimum voltage before providing the plurality of first data voltages to the first pixel group.

14. The driver circuit of claim 12, wherein the driver circuit is configured to be coupled with the plurality of data lines through a multiplexer comprising a plurality of switches, and the driver circuit is configured to provide a plurality of control signals correspondingly for the plurality of switches, if some of the plurality of first data voltages are higher than corresponding ones of the second data voltages, the driver circuit sets corresponding ones of the plurality of control signals to a logic high level to select the some of the plurality of data lines to receive the reset voltage being equal to the maximum voltage before providing the plurality of first data voltages to the first pixel group.

* * * * *